United States Patent [19]

Arnold et al.

[11] 4,297,418

[45] Oct. 27, 1981

[54] COMPONENT STRAND FOR WIRE FABRICS

[75] Inventors: Harmon W. Arnold; Galen B. Erwin, both of Carthage, Mo.

[73] Assignee: Flex-o-lators, Inc., Carthage, Mo.

[21] Appl. No.: 43,112

[22] Filed: May 29, 1979

[51] Int. Cl.[3] ..... B21F 33/00

[52] U.S. Cl. ..... 428/595; 428/586; 428/593; 428/609; 245/2; 245/3; 245/8; 245/11

[58] Field of Search ..... 428/586, 593, 595, 609; 245/2, 3, 8, 11

[56] References Cited

U.S. PATENT DOCUMENTS

| | | | |
|---|---|---|---|
| 369,372 | 9/1887 | Turner | 428/586 |
| 1,844,077 | 2/1932 | Silverman | 428/595 |
| 3,730,227 | 5/1973 | Roberts | 428/586 |
| 3,835,242 | 9/1974 | Critchlow et al. | 428/595 |

FOREIGN PATENT DOCUMENTS

| | | | |
|---|---|---|---|
| 235696 | 11/1942 | Switzerland | 428/609 |

*Primary Examiner*—Brooks H. Hunt
*Attorney, Agent, or Firm*—John A. Hamilton

[57] ABSTRACT

A special component strand for wire fabrics, the fabric consisting of one or more of the special strands extending in spaced apart generally parallel relation, and spaced apart, generally parallel cross wires extending transversely to the special strands, each cross wire being attached to each of the special strands at its point of intersection therewith, as by piercing said special strand or by being wrapped or twisted tightly thereabout. The special strand of the present invention consists of a spring wire core having a sheath of tough but compressible material having alternating ribs and grooves formed longitudinally in the surface thereof, the ribs permitting easy indentation of the strand by a cross wire twisted thereabout, for a more secure connection, and a pair of opposite grooves thereof reducing the strand to a relatively narrow neck for easier piercing by said cross wires.

5 Claims, 13 Drawing Figures

COMPONENT STRAND FOR WIRE FABRICS

Figure 1:
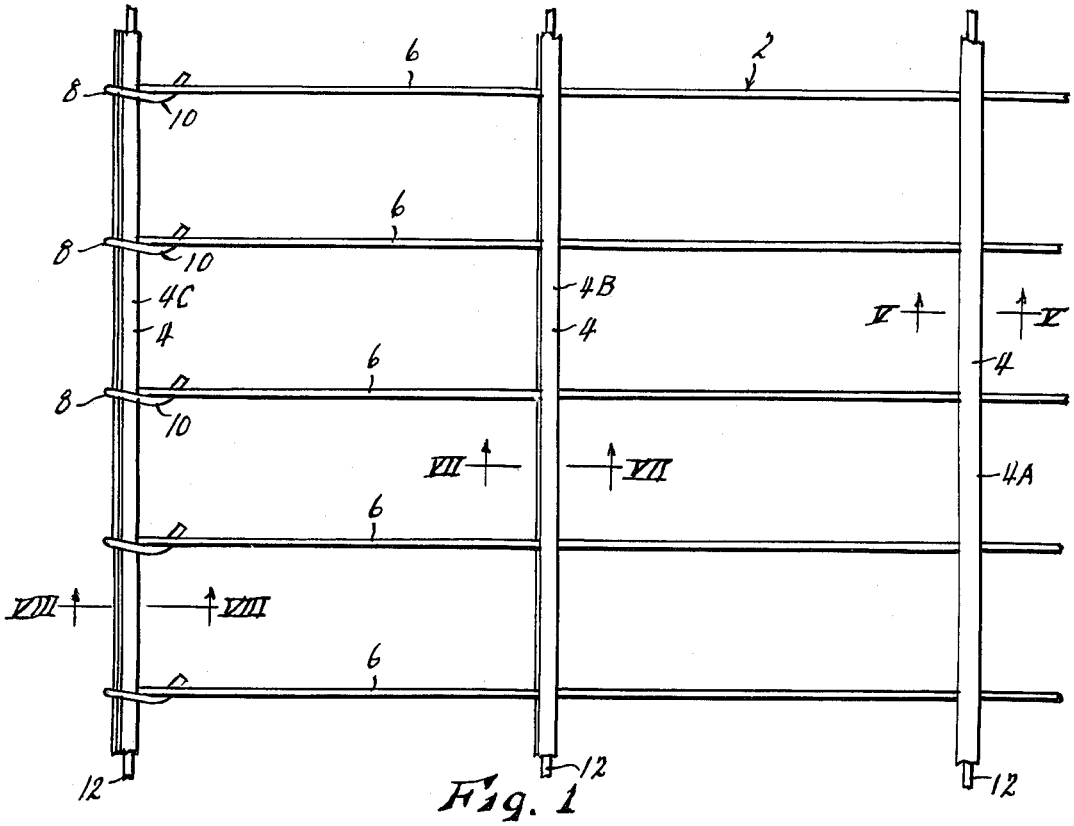

This invention relates to new and useful improvements in wire fabrics, and has particular reference to a special component strand to be utilized in such fabrics. The fabrics with which the present invention is primarily concerned consist of right-angled longitudinal and transverse wires attached together at their points of intersection, such as have wide usage in furniture and seating applications. For example, such fabric, if resiliently supported, can serve as the spring base for seating cushions and the like. It's plane can be configurated to shape a seat, such as to form the inclined side holsters of bucket-type automotive seating. It can be encapsulated as reinforcing and supporting means into rubber or synthetic foam seats. Narrow lengths thereof encapsulated in foam seating cushions can serve as anchoring means to which to attach the decorative cover or trim sheet with which said foam cushions are ordinarily covered. It can be used as a padding support when inserted between the padding layers and the coil springs of a mattress or the like. Other uses are of course possible, both in the furniture and seating field, and elsewhere.

A continuing problem in connection with wire fabrics of this type has been the economical, efficient and rapid production thereof. A production method in common use, and that used in the present case is the use of a "weaving" machine in which a series of longitudinal strands are fed intermittently in generally parallel relation through suitable dies, and the cross wires "shot" longitudinally into position, one at a time and at a given station, while the longitudinal strands are at rest, the cross wires piercing the intermediate longitudinal strands, then cut to length and twisted about the sidemost longitudinal strands. The longitudinal strands were often formed of a soft material such as twisted paper in order to permit them to be pierced by the cross wires. One disadvantage resulting from the use of such soft longitudinal strands was that since such strands are essentially pliable and non-resilient, the resulting fabric had little if any resilience about axes at right angles thereto. Also, such soft strands could be cut or severed by the cross wires, particularly in the repetitive flexures to which the fabric is ordinarily subjected, thus impairing the structural integrity of the fabric. Also, the intermediate longitudinal strands could slide freely along the cross wires, thus distorting the fabric.

It has long been known to include a strong spring wire core in the sidemost of the longitudinal strands, in order to prevent severance thereof by the cross wires twisted thereabout, and to provide a higher degree of fabric resilience about transverse axes, at least at its sides. However, even then there remained the problem of proper selection of the hardness of the sheathing material. If too soft, it was still cut by the cross wires, thus being destroyed and permitting contact of the cross wires with the core wire, which causes objectionable rubbing or grating "wire noises". If too hard the sheath could nt be indented sufficiently by the cross wire loops twisted thereabout to prevent slippage of said loops therealong, which distorted the fabric. Prior U.S. Pat. No. 3,829,048, owned by the assignee of the present application, shows an earlier attempt to solve the problems at the intermediate longitudinal strands, in which each intermediate strand is provided with a plastic sheath having a longitudinal radially projecting rib pierced by the cross wires, with the frictional grip of the plastic on the cross wires being relied on to prevent slippage. However, the problem of a proper hardness for the sheath still remained. If too soft, it provides little frictional grip on the cross wires. If too hard, it may be virtually impossible to drive the cross wires with enough force to pierce them, especially if the fabric is wide and includes many longitudinal strands. In recognition of this problem, said prior patent also discloses the idea of bending or crimping the cross wires at the longitudinal strand to further inhibit slippage of the latter along the former. However, such bends create points of stress concentration in the cross wires, at which they may fracture as a result of the multitudinous flexings to which the fabric is normally subjected, and the sheaths did nothing to alleviate such stresses. Also, the irregular cross-sectional contour of the strand rendered it rather difficult to accommodate in the guiding dies of the weaving machine, to orient it properly to the cross wires for the piercing thereof, and difficult to insert it into and remove it from the positioning clips used in foam molding cavities for positioning the fabric in the cavity for the molding of foam thereabout. Accordingly, the primary object of the present invention is the provision of a novel component strand for use in wire fabrics of the type described, usable either as intermediate or side longitudinal strands, which largely answers all of the above enumerated problems of prior strands, in an efficient and economical warmer.

More specfically, the object of the present invention is the provision of a component strand of the character described consisting of a core wire about which is molded a continuous sheath formed of a relatively soft but compressible and piercable material, said sheath being of generally circular cross-sectional contour whereby to facilitate its accomodation in the guiding dies of fabric weaving machines and its acceptance in positioning clips of foam molding cavities, and having alternate ribs and grooves formed longitudinally on its outer surface. If the cross wires are to be twisted thereabout, the ribs reduce the contact of each cross wire therewith, so that is may be indented more easily and deeply by the cross wire loop twisted thereabout, in order to prevent slippage of the cross wire loop therealong. The voids provided by the grooves also increase this compressive yieldability of the sheath. Thus a harder, firmer and stronger sheath material than previously permissible may be used, in order to prevent cutting of the sheath by the cross wire loops. If the strand is to be pierced by the cross wires, at least diametrically opposite pairs of said grooves reduce the thickness of the strand to a narrow neck which may be easily pierced by the cross wires even though formed of relatively hard material. The core wire is offset from this neck so as not to impede the cross wires. If the cross wires are to be bent or crimped at one of the pierced longitudinal strands, the core wire comprises an anvil about which the bend may be formed, and the ribs form a solid wire-supporting bulk within the bend to alleviate stress concentrations in the bend. The grooves also facilitate angular orientation of the strands in the weaving machine to receive the cross wires through the neck thereof.

Figure 2:
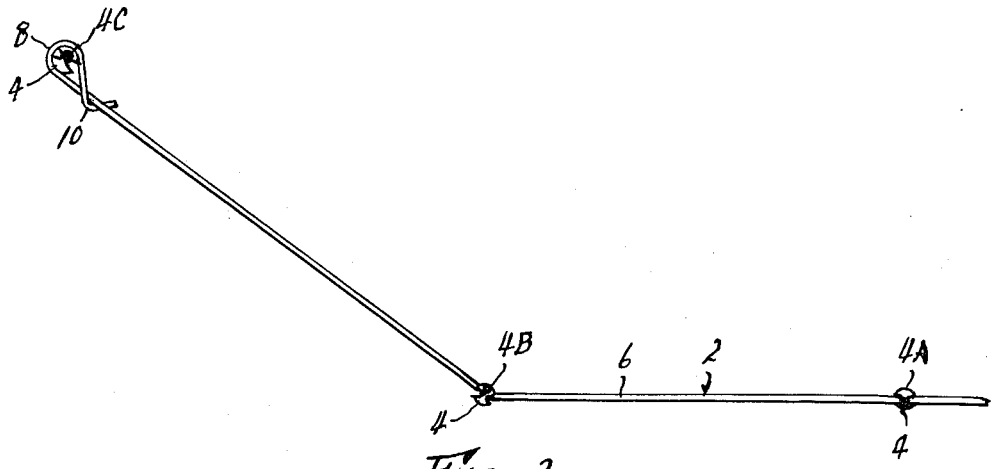
Figure 3:
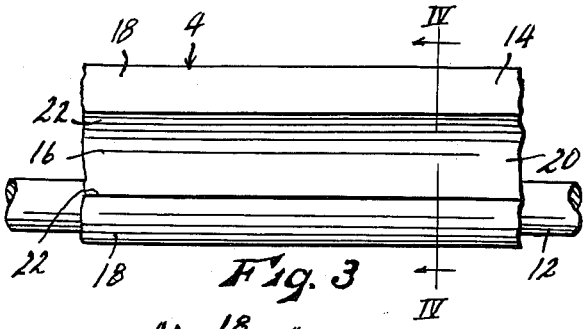
Figure 4:
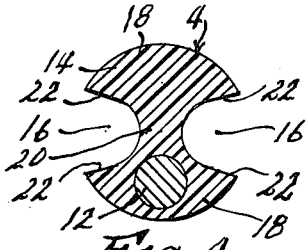
Figure 5:
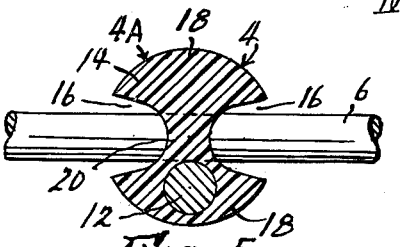
Figure 6:
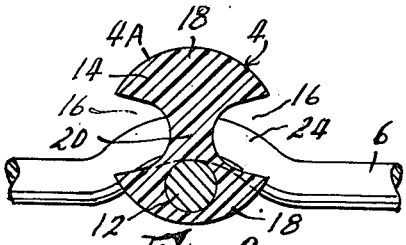
Figure 7:
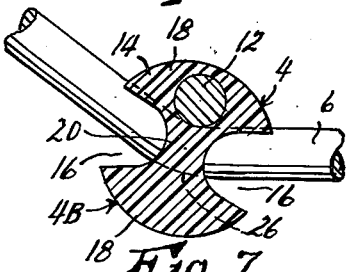
Figure 8:
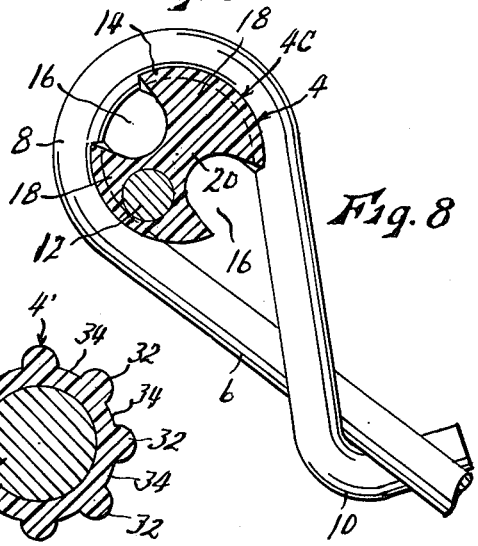
Figure 9:
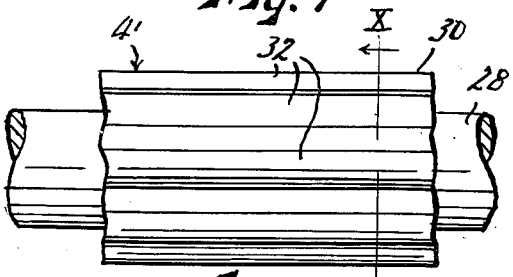
Figure 10:
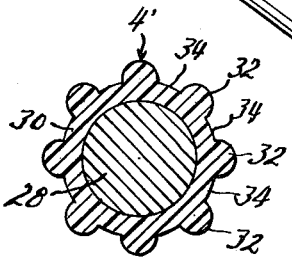
Figure 12:
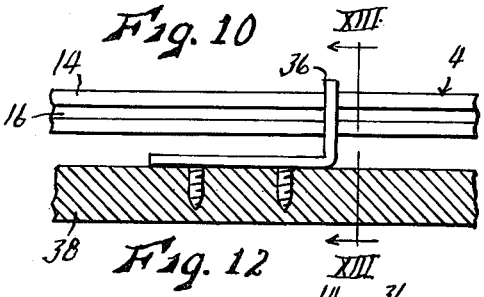
Figure 11:
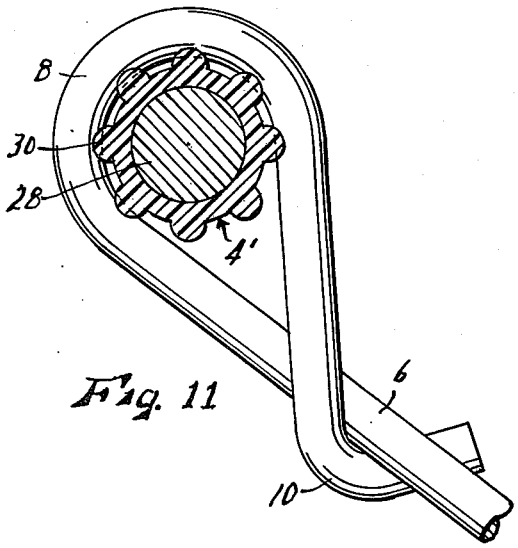
Figure 13:
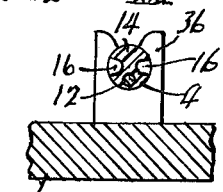

With this as well as other objects which will appear in the course of the specification in mind, reference will be had to the accompanying drawing, wherein:

FIG. 1 is a fragmentary plan view of an edge section of a wire fabric incorporating component strands embodying the present invention as the longitudinal strands thereof, FIG. 2 is an edge view of the fabric shown in FIG. 1, FIG. 3 is a side view of a section of a preferred form of the component strand, with portions of the sheath broken away, FIG. 4 is a sectional view taken on line IV—IV of FIG. 3, FIG. 5 is an enlarged, fragmentary sectional view taken on line V—V of FIG. 1, FIG. 6 is a view similar to FIG. 5, but showing a slight modification in the formation of the fabric, FIG. 7 is an enlarged, fragmentary sectional view taken on line VII—VII of FIG. 1, FIG. 8 is an enlarged, fragmentary sectional view taken on line VIII—VIII of FIG. 1, FIG. 9 is a view similar to FIG. 3, but showing a slight modification of formation of the component strand, FIG. 10, is a sectional view taken on line X—X of FIG. 9, FIG. 11, is a view similar to FIG. 8, utilizing the modified component strand of FIGS. 9 and 10, FIG. 12 is a reduced side view of the component strand as shown in FIG. 3, shown operatively engaged in a positioning clip of a foam molding cavity, and FIG. 13 is a sectional view taken on line XIII—XIII of FIG. 12.

Like reference numerals apply to similar parts throughout the several views, and in FIGS. 1 and 2, the numeral 2 applies generally to a representative wire fabric capable of utilizing component strands 4 embodying the present invention. As indicated, strands 4 extend in generally parallel, spaced apart relation, constituting what may be termed the longitudinal strands of the fabric, and are connected by a series of generally parallel, spaced apart cross wires 6, usually formed of oil-tempered spring steel, extending transversely to strands 4, each of the cross wires being attached to each of strands 4 at its point of intersection therewith. The plane of the fabric is of course defined by strands 4 and cross wires 6. Strands 4 may be disposed at various positions relative to the width of the fabric, for example at any intermediate point in the lengths of the cross wires, as exemplified by the strand 4 further designated as 4A, or along a line on which the fabric is angled by bending cross wires 6, as exemplified by the strand further designated by 4B, or along a longitudinal edge of the fabric as exemplified by the strand 4 further designated as 4C. Cross wires 6 are twisted tightly around strand 4C, as indicated at 8, and further may be twisted about their own standing portions, as indicated at 10, to form "knots". Cross wires 6 pierce strands 4A and 4B. The fabric is ordinarily formed by advancing strands 4 concurrently and intermittently, through suitable guiding dies, in a weaving machine operable to shoot cross wires longitudinally into place, to pierce strands 4A and 4B, one at a time and at a single station, each time strands 4 come to rest, then cut each wire 6 to length and twist it about strands 4C (one at each side of the fabric). The bends of cross wires 6 at strand 4B, and any bends of said cross wires at strand 4A, as will be described, are formed after the fabric is otherwise completed.

A preferred form of strand 4, shown in FIGS. 1-8, 12 and 13, includes a core wire 12, which may also be of oil-tempered spring steel, about which is formed a sheath 14 formed of a relatively soft, compressible and piercable material such as polyethylene of various densities. Said sheath is of generally circular cross sectional contour, and has a pair of deep, diametrically opposite grooves 16 formed longitudinally therein, as by extrusion through a suitable die together with core wire 12. Grooves 16 divide the sheath, considered in cross-section, into a pair of generally segmental "heads" or "ribs" 18 connected by a narrow neck portion 20. Core wire 12 is disposed within one of ribs 18, and does not obstruct neck 20 to inhibit piercing of said neck by cross wires 6. The opposite walls 22 of each groove 16 (see FIGS. 3 and 4) are outwardly divergent, but are angled acutely to each other at an angle less than any angle to which it is likely it might be desired to bend cross wires 6 at any of strands 4A or 4B pierced by said cross wires.

The strand 4 as thus described has several advantages. The grooves 16 thereof may be engaged by corresponding ribs disposed in the guiding dies of the fabric weaving machine, whereby to prevent the strand from twisting axially, and to maintain the strand in the proper angular attitude to present neck 20 thereof to receive cross wires 6 therethrough. The inward convergence of walls 22 of the grooves serves further to guide or "funnel" the cross wires to the narrowest portion of strand neck 20, for easiest penetration thereof. The easy piercing penetration provided by the reduced thickness of neck 20 also permits the use of a sheathing material harder than would otherwise be possible, since harder material of course requires greater force to drive the cross wires therethrough than do softer materials. On the other hand, harder materials provide a greater frictional grip on the cross wires in the finished fabric, and hence are more effective in holding strands 4 in position on wires 6 to preserve the form and structural integrity of the fabric, and are hence preferable. For example, with the proportions shown, the necking of strands 4 by grooves 16 permits the use of a high density polyethylene, of a hardness of about 65 on the Shore D scale, as a sheathing material, while if the sheath were not necked, a low density polyethylene of a hardness of about 45 on the Shore D scale would be required. By properly correlating the neck thickness and hardness to the available force for driving the cross wires therethrough, a maximum frictional grip of strand 4 on wires 6 can be provided.

To further secure strand 4A against slippage along wires 6, it may be desired to offset or crimp each of wires 6 at strand 4A, as shown in FIG. 6 at 24, with strand 4A disposed in the crimp. Since the angularity of any crimp effective for this purpose is greater than the angled relation between opposite walls 22 of grooves 16, this crimping forces wire 6 into compressing engagement with corresponding walls 22 of the two grooves, as shown, with one of the strand "heads" or ribs 18 compressed therebetween. The strand rib thus serves as a solid wire-supporting bulk at the bend, and tends to alleviate or reduce the stress concentrations which naturally occur at a bend when the finished fabric is subjected to repetitive flexing in usages thereof. This in turn reduces the likelihood of fatigue failure of wires 6 at these points. The relative hardness of sheath 14, permitted as previously described by necking thereof, further increases the effectiveness thereof in providing wire-supporting bulk at bends thereof. The situation, and advantages, at strand 4B wherein the wires 6 are bent unidirectionally within the strand as at 26, as shown in FIG. 7, to change the general plane of the fabric, are substantially the same as at strand 4A.

Whether the cross wires are to be crimped as in FIG. 6, or bent unidirectionally as in FIG. 7, care should be taken to orient the strand 4 to dispose core wire 12 thereof inside of the bend. In this manner, the core wire may serve as a solid "anvil" about which the bends may be formed, the bends of course being formed after the fabric is otherwise complete. For this purpose, the core wire 12 should be positioned in the sheath to be disposed substantially tangent to a cross wire 6 piercing neck 20.

At strand 4C, about which cross wires 6 are twisted as already described, and as shown in FIG. 8, it will be seen that grooves 16 render the strand more readily compressible by the twists of wires 6 thereabout than it would be if it were not grooved, but solid. In other words, the grooves form voids in the strand, so that it may be more readily constricted and indented by the twists of wires 6. This indentation securely anchors the twists against slippage along the strand, while still permitting the use of hard sheath material as previously described. If sheath 14 were solid and formed of hard material, the twists of wires 6 would slip therealong, impairing the structural integrity of the fabric. If solid and formed of softer material, the twists of wires 6 would cut through it.

FIGS. 9–11 show a modified form of strand 4' intended solely for use in the position of strand 4C of FIGS. 1 and 2, that is, as a sidemost longitudinal strand of a fabric, with cross wires 6 twisted thereabout. Strand 4' is similar to strand 4 except that its core wire 28 is disposed coaxially within its generally circular sheath 30, and that the sheath has a larger number (eight as shown) of external longitudinal ribs 32 formed thereon, with alternating grooves 34. Thus when each wire 6 is twisted thereabout as in FIG. 11, it engages only ribs 32, which, due to their limited angular extent, yield to and are indented by said wire to a much greater extent than would be possible if the sheath surface were smooth, and thus permits the use of a harder sheath material as already discussed in connection with FIG. 8.

The general cross-sectional contour of both forms of strand 4 is circular, as best shown in FIGS. 4 and 10. This form better adapts the strand to insertion and guidance in guiding dies of fabric weaving machines, and also to easier insertion into and removal from the positioning clips, one of which is shown at 36 in FIGS. 12 and 13, of a mold cavity, one wall of which is shown at 38, in which it may be desired to mount the fabric accurately while encapsulating it in a natural or synthetic foam cushion. Such clips are commonly of a spring nature, and round strands are more easily inserted therein, and more easily detached therefrom after encapsulation is completed, than strands of irregular cross-sectional contour.

While we have shown and described certain specific embodiments of our invention, it will be readily apparent that many minor changes of structure and operation could be made without departing from the spirit of the invention.

What we claim as new and desire to protect by Letters Patent is:

1. A wire fabric formed of a plurality of component strands extending in generally parallel, spaced apart relation, and a plurality of cross wires extending transversely to said component strands in generally parallel, spaced apart relation, each of said cross wires being attached to each of said component strands at its point of intersection therewith by piercing said strand, at least one of said component strands comprising:

a. a longitudinally extending core wire, and b. a longitudinally extending sheath in which said core wire is embedded, said sheath being formed of a relatively soft, flexible and piercable material, and having its external surface formed to present at least a pair of diametrically opposite, longitudinally extending grooves to configurate said strand cross-sectionally to form a pair of enlarged heads connected by a neck of reduced thickness, said cross wires piercing said neck, said core wire being embedded in one of the heads of said sheath, offset from the neck thereof, whereby not to interfere with the piercing of said neck by said cross wires.

2. A component strand as recited in claim 1 wherein the walls of said sheath defining the lateral sides of each of said diametrically opposite grooves are outwardly divergent from said neck, whereby to be capable of guiding and directing said cross wires to pierce said neck.

3. A component strand as recited in claim 1 wherein said core wire is offset from said neck by such a distance as to be disposed generally tangentially to cross wires piercing said neck, whereby if it may be desired to bend said cross wires within said strand after they have pierced said neck, said bends may be performed using said core wire as a forming anvil, so long as said core wire is disposed at the inner sides of the bends.

4. A component strand as recited in claim 3 wherein the lateral walls of each of said diametrically opposite grooves are outwardly divergent, at a relative angle less than the angularity of any bends of said cross wires likely to be formed, whereby when said bends are formed, said cross wires will engage and indent said groove walls, whereby a head portion of said sheath will then form a wire-supporting bulk within the bends of the cross wires to alleviate stress concentrations normally occuring at such bends.

5. A component strand as recited in claim 1 wherein the external cross-sectional contour of the sheath thereof is generally circular, whereby to facilitate the guiding thereof in guiding dies of fabric weaving machines, and the mounting thereof in positioning clips of foam molding cavities.

* * * * *